US006763593B2

(12) United States Patent
Nakatsu et al.

(10) Patent No.: US 6,763,593 B2
(45) Date of Patent: Jul. 20, 2004

(54) RAZOR BLADE MATERIAL AND A RAZOR BLADE

(75) Inventors: Hideshi Nakatsu, Yasugi (JP); Yasushi Tamura, Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 18 days.

(21) Appl. No.: 10/053,901

(22) Filed: Jan. 24, 2002

(65) Prior Publication Data

US 2002/0174549 A1 Nov. 28, 2002

(30) Foreign Application Priority Data

Jan. 26, 2001 (JP) ..... 2001-019253

(51) Int. Cl.[7] ..... B26B 21/58; C22C 38/22

(52) U.S. Cl. ..... 30/346.54; 30/346.53; 148/325; 148/326

(58) Field of Search ..... 30/346.53, 346.54; 148/320, 325, 326; 420/34

(56) References Cited

U.S. PATENT DOCUMENTS

| | | | | | |
|---|---|---|---|---|---|
| 3,829,969 | A | * | 8/1974 | Fischbein et al. | 30/346.54 |
| 3,835,537 | A | * | 9/1974 | Sastri | 30/346.53 |
| 3,871,836 | A | | 3/1975 | Polk et al. | |
| 4,330,576 | A | * | 5/1982 | Dodd | 30/346.53 |
| 5,275,672 | A | * | 1/1994 | Althaus et al. | 148/325 |
| 5,433,801 | A | * | 7/1995 | Althaus et al. | 148/325 |
| 5,632,826 | A | * | 5/1997 | Hultin-Stigenberg et al. | 148/326 |
| 6,375,764 | B1 | * | 4/2002 | Ito et al. | 148/326 |
| 6,524,405 | B1 | * | 2/2003 | Lin | 148/325 |
| 2003/0102057 | A1 | * | 6/2003 | Short | 148/326 |

FOREIGN PATENT DOCUMENTS

| | | |
|---|---|---|
| GB | 1 592 476 | 9/1977 |
| JP | 49-101235 | 9/1974 |
| JP | 51-4019 | 1/1976 |
| JP | 53-35619 | 4/1978 |
| JP | 54-31023 | 3/1979 |

* cited by examiner

*Primary Examiner*—Hwei-Siu Payer
(74) *Attorney, Agent, or Firm*—Sughrue Mion, PLLC

(57) ABSTRACT

Provided is a razor blade material which has excellent high hardness, high strength and high corrosion resistance. The material is made of an Fe-base alloy containing, by mass %, not less than 0.5% carbon, 9.0 to 14.0% Cr and from more than zero to 8.0% Mo, wherein precipitates, which can be observed at an optional cross section of the razor blade material, have a diameter of less than 0.1 m. The alloy has preferably a chemical composition of 0.5 to 5.0% carbon, 9.0 to 14.0% Cr and 0.5 to 8.0% Mo, 0.5 to 8.0% of B+Si, and the balance of Fe and unavoidable impurities. Preferably, the alloy has a metal structure, not less than 30 volume % of which is amorphous. The material has a thickness of 30 to 100 $\mu$m. The razor blade is preferably coated with polytetrafluoroethylene (PTFE).

22 Claims, 6 Drawing Sheets

INVENTION MATERIAL (EXAMPLE No.4)

NANOCRYSTALLINE STRUCTURE

AMORPHOUS STRUCTURE CONTAINING DISPERSED GRAINS OF NANOCRYSTALLINE STRUCTURE

AMORPHOUS STRUCTURE

INVENTION MATERIAL (EXAMPLE No.4)

COMPARATIVE MATERIAL (EXAMPLE No.C1)

COMPARATIVE MATERIAL (EXAMPLE No.C3)

COMPARATIVE MATERIAL (EXAMPLE No.C4)

INVENTION MATERIAL (EXAMPLE No.8)

INVENTION MATERIAL (EXAMPLE No.10)

COMPARATIVE MATERIAL (EXAMPLE No.C6)

INVENTION MATERIAL (EXAMPLE No.8)

INVENTION MATERIAL ( EXAMPLE

COMPARATIVE MATERIAL (EXAMPLE No.C6)

(a) USUAL HEAT TREATMENT CONDITION
(HEATING RATE: 0.6°C/s)

(b) QUICK HEATING (HEATING RATE: 80°C/s)

RAZOR BLADE MATERIAL AND A RAZOR BLADE

BACKGROUND OF THE INVENTION

1. Field of the Invention

The present invention relates to a razor blade material having excellent mechanical and chemical properties, and to a razor blade made of the material. The razor blade material is characterized by that a razor blade made of the material has a cutting blade portion with high hardness, a good blade edge form accuracy, excellent sharpness, and excellent corrosion and wear resistances.

2. Brief Description of the Related Art

A conventional razor blade is made of a crystalline metal, such as carbon steel or stainless steel, which is coated with a resin. However, a carbon steel razor has problems that are lacking in enough sharpness because of extremely deteriorated hardness due to inadequate resistance to softening by tempering heat treatment, coarse carbides, and deteriorated durability due to inferior corrosion resistance.

A stainless steel razor blade has been made from, for example, a 1% C–13% Cr steel or a 0.65% C–13% Cr steel through a melting-casting process. The former can be of high hardness because of high carbon and high chromium contents, but it is liable to have an alloy structure containing coarse carbides. Therefore, in recent years, the latter of 0.65% C–13% Cr steel has been preferably used. However, while the latter contains a very small amount of coarse carbides which deteriorates the steel in corrosion resistance, it has a problem that a high hardness is not expectable because of a low carbon content.

On the other hand, the usual razor blade is coated with a resin at a temperature of 300 to 400° C. in order to improve a shaving feel. Thus, the razor blade has a problem that a cutting edge portion of the razor blade is deteriorated in hardness down to HV600 to 650 due to heating when resin-coating the razor blade. If strength of the blade edge is inadequate, it is bent during shaving resulting in deteriorated durability. Taking this into consideration, if the carbon amount of the razor blade steel is increased in order to improve the blade edge strength so as to have high hardness, a lot of carbides (which are mainly Cr-containing carbides such as $M_7C_3$ and $M_{23}C_6$) each having a diameter of about not less than 0.1 μm is generated, resulting in deteriorated corrosion resistance, becoming brittle and/or defects such as a break in some using manners.

Therefore, in order to produce a razor blade material from the above materials, it is necessary for those to adjust some material factors including a size and hardness by a combination of heat treatment, hot-rolling and cold-rolling resulting in increased production process steps.

In order to solve the above problems, there has been proposed a material made of an amorphous metal. Since the amorphous metal material can have remarkably improved hardness, strength and corrosion resistance, an alloy component design, which enables the alloys to become amorphous, was intensively examined in a broad range of chemical compositions at the earliest in the 1970s, as can be seen from, for example, JP-A-51-4019. There has been a trial to apply the amorphous metal for a blade material. For example, according to JP-A-54-31023, there is proposed a material being provided with an amorphous structure by adding 2 to 40 wt % of at least one nonmetal element selected from the group of P, C, B, Si, etc. to the material.

SUMMARY OF THE INVENTION

The proposed amorphous metal blade material is effective as means for improving properties of hardness, strength and corrosion resistance. However, it is required for the alloy design to be subjected to quenching solidification at least at a critical cooling rate of about $10^7$ K/second in order to make the alloy amorphous to obtain the improvement effects. Thus, a materials thickness for production is limited to a very small value, so that it is considerably difficult to produce a material having a thickness of about 30 μm.

Further, according to a result that the present inventors examined an amorphous metal on the basis of the above mentioned chemical composition in various points of view, the material having a thickness of about not less than 30 μm did not become completely amorphous, and there occurred deterioration of corrosion resistance and brittleness because a lot of precipitates, each of which had a diameter of about not less than 0.1 μm and which were carbides, borides, etc., was generated in the metal structure. The precipitates were mainly carbides including $M_7C_3$ and $M_{23}C_6$ and borides including $Fe_3B$, $Fe_2B$, $Cr_3b$ and $Cr_2B$.

An object of the present invention is to provide a razor blade material which has excellent corrosion and wear resistances and contains a reduced amount of precipitates, and which can ensures a cutting edge form of a razor blade made thereof to have a good accuracy and excellent sharpness. More particularly, the object is to provide the razor blade material which is made to an amorphous metal structure containing a reduced amount of precipitates and which can have a large thickness and a high hardness of a cutting edge portion. Another object of the present invention is to provide a razor blade made of the razor blade material.

The present inventors intensively studied chemical compositions and microstructures of some variances of the razor blade material. As a result, it has been found that there is a state of precipitates effective for improvement of corrosion resistance and inhibiting brittleness, and that there is a chemical composition range in which alloying elements of C, Cr and Mo are adjusted to have optimized contents, respectively, so as to inhibit formation of precipitates. Further, some alloying elements have been identified, and it has been found also that an appropriate amount of B and Si can be effectively added into the material. The inventors examined also an amorphous structure advantageous for inhibiting formation of precipitates. As a result, the present invention has been achieved.

According to a first aspect of the present invention, there is provided a razor blade material made of an Fe-base alloy comprising, by mass %, not less than 0.5% carbon, 9.0 to 14.0% Cr and from more than zero to 8.0% Mo, wherein precipitates, which can be observed at an optional cross section of the razor blade material, have a diameter of less than 0.1 μm, respectively.

According to a second aspect of the present invention, there is provided a razor blade material made of an Fe-base alloy consisting essentially of, by mass %, not less than 0.5% carbon, 9.0 to 14.0% Cr and from more than zero to 8.0% Mo, B and/or Si in an amount as defined by the equation of $0<B+Si\leqq 8.0\%$, and the balance of Fe and unavoidable impurities, wherein precipitates, which can be observed at an optional cross section of the razor blade material, have a diameter of less than 0.1 μm, respectively. The razor blade material has high hardness, high strength and good corrosion resistance.

According to a third aspect of the present invention, there is provided a razor blade material made of an Fe-base alloy comprising, by mass %, not less than 0.5% carbon, 9.0 to 14.0% Cr and from more than zero to 8.0% Mo, wherein no precipitate can be observed at an optional cross section of the razor blade material.

According to a fourth aspect of the present invention, there is provided a razor blade material made of an Fe-base alloy consisting essentially of, by mass %, not less than 0.5% carbon, 9.0 to 14.0% Cr and from more than zero to 8.0% Mo, B and/or Si in an amount as defined by the equation of $0<B+Si\leqq 8.0\%$, and the balance of Fe and unavoidable impurities, wherein no precipitate can be observed at an optional cross section of the razor blade material.

Preferably, a metal structure of the razor blade material includes an amorphous structure in a volume fraction of not less than 30 volume %. Thereby, the corrosion resistance and mechanical properties are greatly improved. Herein, the term of "amorphous structure" may include also a grain boundary layer which is a kind of amorphous structure.

Further preferably, the razor blade material of the present invention has a thickness of 30 to 100 $\mu$m.

Further, preferably, the razor blade material of the present invention may be coated with polytetrafluoroethylene (PTFE). This improves a feeling during shaving.

A key aspect of the invention resides in that the razor blade material can be of a small content of fine precipitates by virtue of an adjusted optimum chemical composition. More particularly, according to the razor blade material, precipitates each having a diameter of not less than 0.1 $\mu$m can not be observed at an optional cross section thereof. In order to obtain the alloy structure of the invention, for example, it is effective to use a quenching solidification method according to which a thick amorphous material, particularly including an amorphous structure in a volume fraction of not less than 30 volume %, can be produced even if a solidification rate is at a critical cooling rate of about 5×104 K/second. Therefore, the above mentioned state of precipitates can be advantageously achieved, and the invention razor blade material can be realized as solidified by quenching.

First, a structure control will be described as a principle of the invention. The invention razor blade material is adjusted to have a small content of fine precipitates in order to obtain high hardness, high strength and good corrosion resistance. It is an efficient way for such an adjustment to make the material to have an amorphous structure.

In order to obtain such a metal structure according to the invention, a matrix of the material is controlled to become a nanocrystalline structure, an amorphous structure containing a dispersed nanocrystalline structure or an amorphous structure. FIGS. 1A to 1C show schematic illustrations of typical microstructures of the invention. When the matrix is the nanocrystalline structure (see FIG. 1A), a carbide precipitation is inhibited because the volume of a grain boundary layer as a kind of amorphous structure increases whereby a solid-soluble limit of solute elements in the grain boundary layer increases. For example, a usual industrial product of razor blade materials has a grain size of about 10 $\mu$m, and contains the grain boundary layer in a volume fraction of about 0.02%. On the other hand, if the nanocrystalline structure has a grain size of about 10 nm, its grain boundary layer has a volume fraction of about 20%, so that the solid-soluble limit of solute elements increases by about 1000 times.

Moreover, when the matrix has the amorphous structure containing dispersed grains of the nanocrystalline structure (see FIG. 1B), it is hard to be a site of precipitation, because, in addition to the above effect in the case of the nanocrystalline structure, an interface between the nanocrystalline structure and an amorphous structure has a low interface energy like as an interface between a solidus and liquidus, and has a closed-packed atomic arrangement without excess voids. In the case where a matrix has an amorphous structure (see FIG. 1C), it will be needless to say that formation of precipitates is effectively inhibited. Thus, it is possible to inhibit formation of precipitates in such an adjusted alloy structure, where by providing the alloy material with a combination of high hardness, high strength and good corrosion resistance.

According to the above described technique, no precipitate can be observed in the metal structure of the invention razor blade material, or the metal structure contains precipitates each having a diameter of less than 0.1 $\mu$m, and the invention material has a metal structure without crystal grain boundaries which usual crystalline metals have, because it is controlled to have the nanocrystalline structure, the amorphous structure containing dispersed grains of the nanocrystalline structure or the amorphous structure. Therefore, a cutting edge region can be finished to be smoother when forming a cutting edge in a finishing process of razor blades, and sharpness during use of the razor blade is also remarkably improved.

Herein below, there will be provided a description of the component elements of the invention razor blade material and a reason why contents of alloying elements are limited to given amounts, respectively.

(a) C: not less than 0.5%

Carbon is an element necessary for improving strength of the material. A much carbon content lowers the melting point of the material and improves productivity of the same. Thus, the carbon content is set to be not less than 0.5%. Preferably, the carbon content is not more than 5.0% in order to inhibit crystallization of graphite.

(b) Cr: 9.0 to 14.0%

Cr is a basic element necessary for providing the material with corrosion resistance, and required to be not less than 9.0% Cr in order to ensure substantially the same level corrosion resistance as that of stainless steel. However, a Cr content exceeding 14.0% makes the material not only expensive but also susceptible to crystallize coarse network carbides resulting in deteriorated hot-workability and a low productivity. In order to prevent the crystallization of carbides, quick quenching is necessary for the material. Therefore, the Cr content is set to be 9.0 to 14.0%.

(c) Mo: not more than 8.0%

Mo improves corrosion resistance. Mo is effective for not only preventing coarsening of Cr-containing carbides but also preventing precipitation of other carbides, since it occupies precipitation sites of Cr-containing carbides ($M_7C_3$ or $M_{23}C_6$) susceptible to be coarse and is effective for lowering a diffusion activity of carbon because of a high affinity for carbon. However, when the Mo content is much, a brittle phase precipitates to deteriorate the material in corrosion resistance and toughness, the brittle phase comprising a lot of Mo-containing carbides (including $Mo_2C$) and composite borides (including $Mo_2(Fe, Cr)B_2$, $Fe_{13}Mo_2B_5$, $Mo_3B$ and $Mo_2B$). Thus, an upper limit value is set to be 8.0%. Preferably, the Mo content is not less than 0.5% in order to obtain the above effects.

While the invention material is directed to an Fe-base alloy containing the above components with specific contents, respectively, it is effective for the material to contain B (boron) and Si in order to further improve characteristics of the material.

(d) B+Si: not more than 8.0%

Both elements B and Si promote a transformation of a alloy structure of the material into amorphous. However, a much amount of the elements prevents such a structural transformation and causes a lot of brittle phase to precipitate resulting in deteriorated toughness, the brittle phase comprising composite borides (including $Mo_2(Fe, Cr)B_2$, $Fe_{13}Mo_2B_5$, $Mo_3B$ and $Mo_2B$), $Fe_3Si$ and $Fe_2Si$. Thus, in the present invention, an upper limit of a total content of one or both of the elements is set to be 8.0%. Preferably, the content thereof is not less than 0.5% in order to obtain the above effects.

It should be also noted that other elements promoting the structural transformation into amorphous can be added into the material as long as basic actions by the above chemical composition and a microstructure described below are not deteriorated. Such elements may be P, Nb, Zr, Ta, Al, Ga, Ni, Co and Cu.

(e) Precipitates observed at an optional cross section of the material and having a diameter of less than 0.1 $\mu$m (including a case where no precipitate can be observed). The precipitates can improve the material in strength, toughness and wear resistance. However, precipitates having a large size not only deteriorate the toughness but also deteriorate the corrosion resistance because the precipitates deprive Cr and Mo from the matrix while they are effective for improving the corrosion resistance. Therefore, it is important to form an alloy structure in which no precipitates each having a diameter of not less than 0.1 $\mu$m can be observed in order to provide the material with a combination of good alloy properties of strength, toughness, wear resistance and corrosion resistance.

In order to confirm a state of precipitates in the invention material, an alloy structure may be observed by means of a scanning electron microscope or a transmission electron microscope. In the case of the scanning electron microscope, a specimen is produced by electrolytic polishing (including the speed process), and it can be observed at an acceleration voltage of 5 to 15 kV and a magnification of up to 100,000. In the case of the transmission electron microscope, a specimen is produced by ion milling, and it can be observed at an acceleration voltage of 200 kV and a magnification of up to 300,000. The size of precipitates may be determined by converting a maximum diameter of precipitates, obtained by conducting an image processing with utilization of 20 photographs taken at a magnification according to which not less than 20 precipitates are present in one view field, into a corresponding circle diameter.

(f) Amorphous in the alloy structure: a volume fraction of not less than 30%

The amorphous structure remarkably improves corrosion resistance and strength of the material. Further, if a grain boundary layer as a kind of amorphous structure increases, it is possible to inhibit the above carbides, composite borides and so on from precipitating because a solid-soluble limit of solute elements in the grain boundary layer increases. Therefore, a volume fraction of the amorphous structure is preferably not less than 30%, more preferably not less than 50% and desirably not less than 70%.

In order to confirm the volume fraction of the amorphous structure in the invention material, it is possible to conduct, for example, a structural observation by means of a transmission electron microscope, and an analysis by means of an electron beam diffraction and an X-ray diffraction. As one example, first an X-ray diffraction process is conducted, and subsequently the structural observation by means of the transmission electron microscope or the analysis by means of the electron beam diffraction is conducted. The transmission electron microscope observation is conducted under the above mentioned conditions, and the electron beam diffraction may be conducted by a limited view field diffraction method.

Further, the volume fraction of the amorphous structure may be determined as follows.

If the whole matrix is an amorphous structure (see FIG. 1C), it can be confirmed by all the above mentioned methods. If the matrix consists of an amorphous structure and a nanocrystalline structure dispersed in the amorphous structure (see FIG. 1B), the volume fraction of the amorphous structure can be obtained by determining the volume fraction of the dispersed nanocrystalline structure by means of an observation with utilization of a transmission electron microscope and an image analysis, thereafter calculating the volume fraction of the amorphous structure by subtracting the volume fraction of the nanocrystalline structure from the total volume. If the matrix consists of a nano-crystal structure (FIG. 1A), the volume fraction of the nano-crystal structure can be obtained by determining a grain size of the nanocrystalline structure (*Note: the cutting method such as rhombic dodecahedron approximation is used for the determination) by means of an observation with utilization of a transmission electron microscope, and thereafter a volume of a grain boundary layer may be calculated on the basis of the determined grain size and a generally agreed grain boundary thickness (assumed to be about 1 nm).

(g) Thickness of 30 to 100 $\mu$m

One feature of the invention razor blade material is that it can have a thickness of not less than 30 $\mu$m. Thereby, it is possible to minimize or omit the post-casting process steps of hot-working, cold-working, heat treatment and so on, whereby production process steps can be notably saved. For example, in the case where the invention razor blade material is produced by the quenching solidification method, it can be used as solidified by quenching.

(h) Coating with polytetrafluoroethylene (PTFE)

The invention razor blade material is characterized by that it may be used with a coat of polytetrafluoroethylene (PTFE). Thereby, a shaving feel, which is one of important properties of the razor blade, can remarkably improved.

As mentioned above, it is effective to use the quenching solidification method in order to obtain the invention razor blade material. In this case, when the solidification rate is a level of critical cooling rate of $5\times10^4$ K/second, the invention razor blade material may be as solidified by quenching, and it is possible to attain the blade material having a thickness of not less than 30 $\mu$m. However, it should be noted that an excess thickness is inappropriate in order to attain the amorphous structure, and that the upper limit of thickness of the material as solidified by quenching, which is attainable at the cooling rate mentioned above, is an order of 100 $\mu$m. Therefore, the thickness of the invention material is set to be a range of 30 to 100 $\mu$m.

According to the chemical composition of the invention material, as described above, although it is of a component system according to which comparatively large precipitates including carbides are generated when the material is produced by a usual melting and casting method, it is possible to minimize precipitates by applying a producing method such as the quenching solidification method. In this case, even if the solidification rate is a level of critical cooling rate of $5\times10^4$ K/second, it is possible to attain a metal structure in which no precipitate having a diameter of not less than 0.1 μm can be observed at an optional cross section of the material. Thus, it is possible to produce a blade material having a larger thickness than the conventional material. Thereby, the invention material is advantageously used for a razor blade material such that, when a razor blade is made from the material, a cutting edge portion thereof has a high hardness, a good accuracy of the edge form, an excellent sharpness, and excellent properties of corrosion resistance and wear resistance.

Additionally, it is possible to raise some examples of the manufacturing method of the invention blade material having the structure in which no precipitate having a diameter of not less than 0.1 μm can be observed. They are a casting method using a copper mold, a suction casting method and a molten metal forging method according to which the solidification rate corresponding to the critical cooling rate of $5\times10^4$ K/s can be obtained, a liquid quenching method (e.g. a single roll method) according to which quick-quenching is possible, a gas phase condensation method (e.g. an electron beam vapor deposition method), a solid phase reaction method (e.g. mechanical alloying), a chemical reduction method (e.g. a plating method), and so on.

According to the invention razor blade material, the amorphous structure having a volume fraction of not less than 30 volume % is hardly transformed even under a usual heat treatment condition (i.e. a heating rate of about 0.6° C./s) for coating the material with polytetrafluoroethylene (PTFE), and a sufficient effect can be expected in the case of rapid heating at not less than 80° C./s.

As described above, according to the present invention, it is possible to provide the material which has a comparatively large thickness, high hardness, high strength and high corrosion resistance. Thus, it is just suitable for a razor blade material. The invention material can be applied to other cutlery as well as razors.

The patent or application file contains at least one drawing executed in color. Copies of this patent or patent application publication with color drawing(s) will be provided by the U.S. Patent and Trademark Office upon request and payment of the necessary fee.

DESCRIPTION OF THE EMBODIMENTS

Figure 1A:
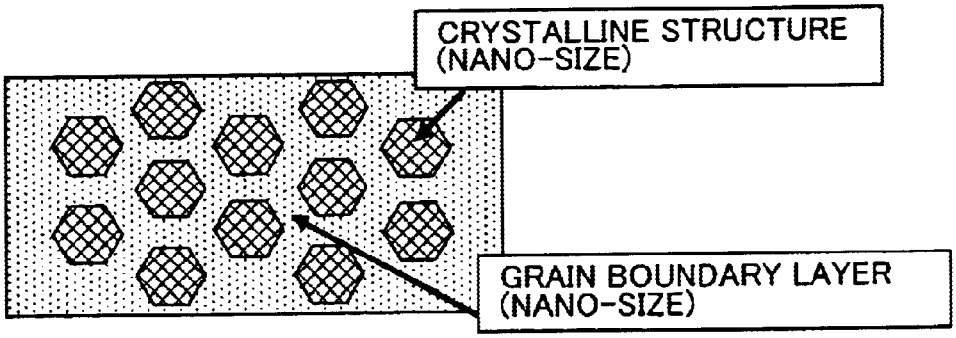
FIG. 1A is a schematic drawing of a nanocrystalline structure of a matrix as a typical microstructure to show an effect of the invention.
Figure 1B:
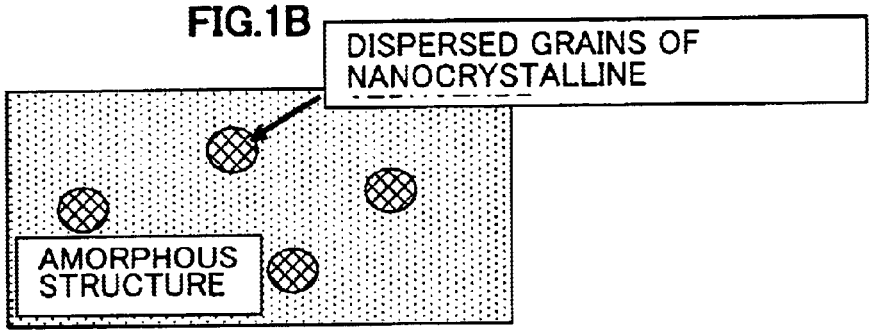
FIG. 1B is a schematic drawing of an amorphous matrix in which nanocrystalline grains are dispersed, as a typical microstructure, to show an effect of the invention.
Figure 1C:
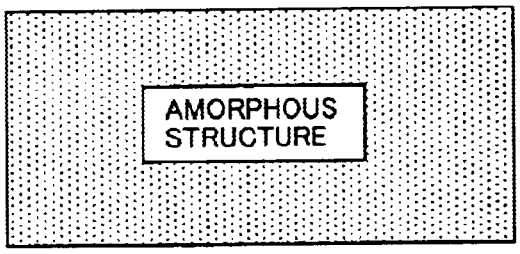
FIG. 1C is a schematic drawing of a whole amorphous matrix as a typical microstructure to show an effect of the invention.
Figure 2A:
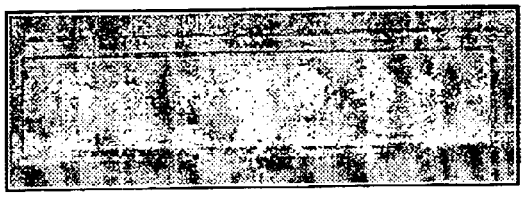
FIG. 2A is a sketch showing a state of evaluation result A of corrosion resistance as an appearance of rust status after a salt water spray test to show an effect of the invention.
Figure 2B:
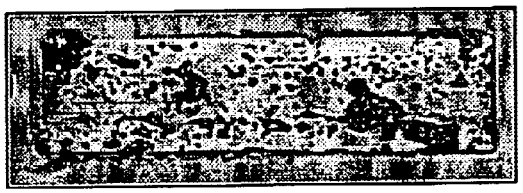
FIG. 2B is a sketch showing a state of evaluation result E of corrosion resistance as an appearance of rust status after a salt water spray test to show an effect of the invention.
Figure 2C:
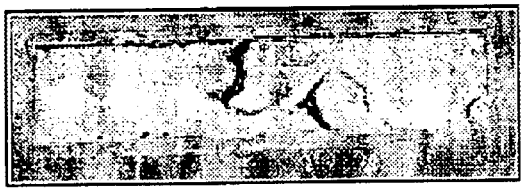
FIG. 2C is a sketch showing a state of evaluation result C of corrosion resistance as an appearance of rust status after a salt water spray test to show an effect of the invention.
Figure 2D:
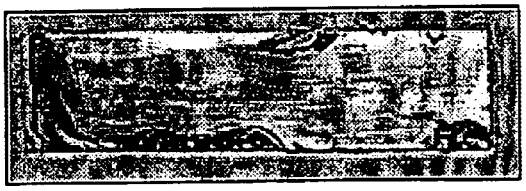
FIG. 2D is a sketch showing a state of evaluation result D of corrosion resistance as an appearance of rust status after a salt water spray test to show the effect of the invention.

Herein below, there will be provided a detailed description of embodiments of the present invention.

First, there will be described a standard method of producing example materials. While the invention razor blade material can be produced by the above mentioned various methods, herein the liquid quenching method (i.e. the single roll method) was used. That is, molten alloys each having adjusted components were continuously cast onto a metallic roll rotating at a high speed to quench the molten alloys (at a critical cooling rate of $10^4$ to $10^5$ K/s), respectively, so that metallic strips were produced.

A size of precipitates was determined by the observation on the basis of the above-described way in which a scanning electron microscope (Acceleration voltage: 10 kV, Magnification: 50,000) and a transmission electron microscope (Acceleration voltage: 200 kV, Magnification: 200,000) were used. The respective microstructure was evaluated by means of an observation with utilization of the transmission electron microscope and by means of electron beam diffraction, thereafter and the microstructure was classified into a nanocrystalline structure, a dispersed nanocrystalline structure or an amorphous structure in accordance with the above-described way.

With regard to an evaluation of the corrosion resistance, a salt water spray test (with a 5% NaCl aqueous solution; at 35° C.; for 24 hours) was carried out, and a rust state of respective example materials was compared with that of a 0.65% C–13% Cr stainless steel (sample No. C1) which often used for razors by an appearance observation. (With regard to an evaluation standard, see FIGS. 2A to 2D, and FIGS. 4A to 4C).

With regard to the toughness of the material, a right angle bending test was carried out, in which the respective example material was evaluated as "D" or "B", wherein "D" is in the case where there arose a breakage at a bending angle of less than 45°, and "B" is in the case where there arose a breakage at a bending angle of not less than 45°.

The hardness of the material was also examined.

EXAMPLE I

Strips having chemical compositions shown in Table 1 were produced by the above-described producing method. In the table, sample Nos. 1 to 6 are the invention materials within a defined chemical composition range according to the invention, and sample Nos. C2 to C4 are comparative materials in which C, Cr and Mo contents are out of the defined chemical composition range of the invention, respectively. Sample No. C1 is a comparative material which is of a 0.65% C–13% Cr stainless steel as a well known razor blade material and which is produced the usual melting and casting method.

TABLE 1

| Sample | Chemical composition (mass %) | | | | | | | |
|---|---|---|---|---|---|---|---|---|
| No. | C | Cr | Mo | B | Si | Mn | Fe | Remarks |
| 1 | 3.60 | 13.20 | 7.80 | 0.005 | 0.01 | 0.02 | bal. | Invention |
| 2 | 4.50 | 11.10 | 6.80 | 0.002 | 0.02 | 0.02 | bal. | Material |
| 3 | 0.61 | 13.40 | 4.12 | 1.47 | 5.30 | 0.01 | bal. | |
| 4 | 2.13 | 10.22 | 5.34 | 1.92 | 1.59 | 0.02 | bal. | |
| 5 | 1.98 | 12.76 | 3.87 | 1.48 | 0.54 | 0.02 | bal. | |
| 6 | 3.64 | 9.45 | 5.75 | 3.67 | 4.25 | 0.02 | bal. | |
| C1 | 0.62 | 13.21 | 0.02 | 0.004 | 0.25 | 0.36 | bal. | Compara- |
| C2 | 0.41 | 9.68 | 3.73 | 1.54 | 0.51 | 0.02 | bal. | tive |
| C3 | 1.97 | 4.86 | 2.01 | 1.42 | 3.37 | 0.02 | bal. | material |
| C4 | 1.66 | 12.87 | 10.34 | 1.87 | 4.89 | 0.02 | bal. | |

The samples in Table 1 were evaluated by the above-described evaluation way, and a result of the evaluation is shown in Table 2. FIGS. 2A to 2D show typical evaluation results of corrosion resistance which are of appearances of rust status as salt water spray test results with regard to invention sample No. 4, and comparative sample Nos. C1, C3 and C4.

TABLE 2

| Sample No. | Micro structure | Volume fraction of amorphous structure (%) | Precipitate size (μm) | Hardness (HV) | Corrosion resistance | Tough-ness | Remarks |
|---|---|---|---|---|---|---|---|
| 1 | Nano-grains | 48 | 0.06 | 866 | A | B | Invention |
| 2 | Dispersed nano-grains | 72 | 0.02 | 927 | A | B | Material |
| 3 | Dispersed nano-grains | 34 | 0.06 | 795 | A | B | |
| 4 | Amorphous | 100 | None | 846 | A | B | |
| 5 | Amorphous | 100 | None | 851 | A | B | |
| 6 | Amorphous | 100 | None | 857 | A | B | |
| C1 | Micron grains | 0.04 | 0.23 | 634 | E | B | Compara- |
| C2 | Amorphous | 100 | None | 610 | A | B | tive Material |
| C3 | Amorphous | 100 | None | 795 | C | B | |
| C4 | Dispersed nano-grains | 25 | 0.08 | 821 | D | D | |

Invention sample Nos. 1 to 6 have higher hardness of not less than HV 700, and has excellent corrrosion resistance without rust, as compared with comparative sample No. C1. Comparative sample No. C2, which has a carbon content smaller than that in the defined chemical composition range of the invention, has a hardness of about HV 600 which is lower than that of comparative sample No. C1. Comparative sample No. C3, having a Cr content smaller than that in the defined chemical composition range of the invention, has not so enough corrosion resistance while exhibiting slightly less rust than comparative sample No. C1. Comparative sample No. C4, having an Mo content higher than that in the defined chemical composition range of the invention, has deteriorated corrosion resistance and toughness since there were precipitated a brittle phase including carbides, borides and so on each of which contains Mo.

EXAMPLE II

Strips having chemical compositions shown in Table 3 were produced by the above-described producing method. It should be noted that the all example materials are of within a defined chemical composition range according to the invention.

TABLE 3

| Sample | Chemical composition (mass %) | | | | | | |
|---|---|---|---|---|---|---|---|
| No. | C | Cr | Mo | B | Si | Fe | Remarks |
| 7 | 2.81 | 12.51 | 0.51 | 1.21 | 0.02 | bal. | Invention |
| 8 | 1.82 | 13.66 | 3.87 | 1.41 | 0.51 | bal. | Material |
| 9 | 0.82 | 13.21 | 3.88 | 1.45 | 5.24 | bal. | |
| 10 | 0.82 | 13.21 | 3.88 | 1.45 | 5.24 | bal. | |
| 11 | 4.11 | 10.35 | 5.66 | 3.45 | 1.64 | bal. | |
| 12 | 4.11 | 10.35 | 5.66 | 3.45 | 1.64 | bal. | |
| C5 | 2.81 | 12.51 | 0.51 | 1.21 | 0.02 | bal. | Compara- |
| C6 | 1.82 | 13.66 | 3.87 | 1.41 | 0.51 | bal. | tive material |

The strips were produced under some different conditions among the strips, which include different heat treatment conditions, and different quenching/solidifying rates by varying the thickness, in order to obtain desired example materials. Invention sample Nos. 7 and 8 have the same chemical compositions as those of comparative sample Nos. C5 and C6, respectively, but sample Nos. C5 and C6 contain precipitates of which size is out of the defined invention range since sample No. C5 is heat-treated at higher temperature than that of sample No. 7, and sample No. C6 is heart-treated at higher temperature than that of sample No. 8. Respective combinations of invention sample Nos. 9 and 10, and invention sample Nos. 11 and 12 have the same chemical compositions, but each material of sample Nos. 10 and 12 as solidified by quenching has a thickness exceeding the preferable thickness range in the invention. Sample No. 10 has a larger strip thickness than that of sample No. 9, and sample No. 12 has a larger strip thickness than that of sample No. 11.

Figure 3A:
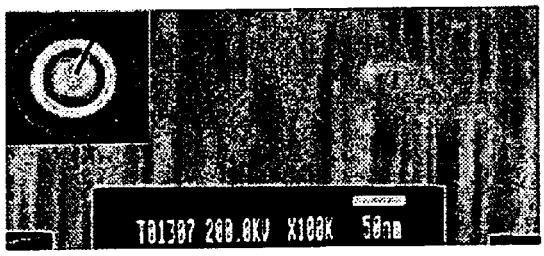
FIG. 3A is a transmission electron microscope photograph showing an amorphous structure containing dispersed grains of a nanocrystalline structure, as a microstructure of the invention, in which precipitates have a diameter of less than 0.1 μm.
Figure 3B:
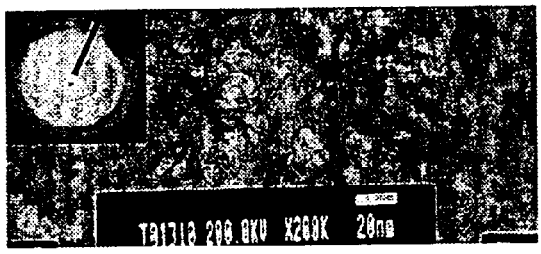
FIG. 3B is a micrograph by a transmission electron microscope showing a nanocrystalline structure, as a microstructure of the invention, in which precipitates have a diameter of less than 0.1 μm.
Figure 3C:
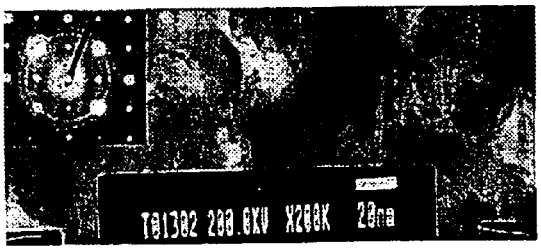
FIG. 3C is a micrograph by a transmission electron showing an amorphous structure containing dispersed grains of a nanocrystalline structure, as a microstructure of a comparative example, in which precipitates have a diameter of not less than 0.1 μm.
Figure 4A:
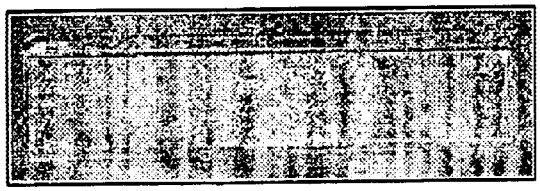
FIG. 4A is a sketch showing a state of evaluation result A of corrosion resistance as an appearance of rust status after a salt water spray test to show an effect of the invention.
Figure 4B:
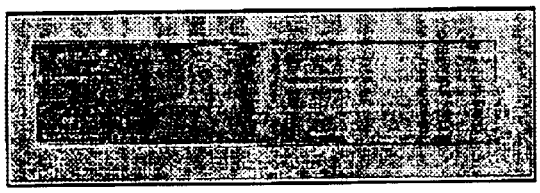
FIG. 4B is a sketch showing a state of evaluation result B of corrosion resistance as an appearance of rust status after a salt water spray test to show an effect of the invention.
Figure 4C:
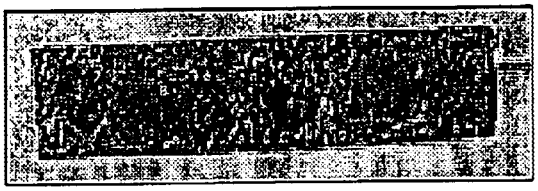
FIG. 4C is a sketch showing a state of evaluation result E of corrosion resistance as an appearance of rust status after a salt water spray test to show an effect of the invention.

Details of microstructures of the samples are shown in Table 4 together with evaluation results which are similar to those in Example I. FIGS. 3A to 3C show micrographs, by a transmission electron microscope, of invention sample Nos. 8 and 10, and comparative sample No. C6 as typical evaluation results of the microstructure. FIGS. 4A to 4C show appearances of rust status of invention sample Nos. 8 and 10, and comparative sample No. C6, after the salt water spray test, as typical evaluation results of the corrosion resistance.

TABLE 4

| Sample No. | Micro structure | Volume fraction of amorphous structure (%) | Precipitate size (μm) | Thickness (μm) | Hardness (HV) | Corrosion resistance | Toughness | Remarks |
|---|---|---|---|---|---|---|---|---|
| 7 | Nano-grains | 52 | 0.07 | 85 | 839 | A | B | Invention |
| 8 | Dispersed nano-grains | 90 | 0.05 | 39 | 836 | A | B | Material |
| 9 | Dispersed nano-grains | 81 | 0.04 | 44 | 805 | A | B | |
| 10 | Nano-grains | 26 | 0.08 | 122 | 794 | B | B | |
| 11 | Amorphous | 100 | None | 33 | 841 | A | B | |
| 12 | Nano-grains | 41 | 0.09 | 187 | 833 | B | B | |
| C5 | Nano-grains | 25 | 0.19 | 57 | 812 | E | D | Comparative |
| C6 | Dispersed nano-grains | 53 | 0.13 | 46 | 801 | E | D | Material |

Invention sample Nos. 7 to 12 exhibit excellent properties in the size of precipitates, hardness and corrosion resistance, and especially sample Nos. 7–9 and 11, which are of a more preferable defined range of the invention, exhibit more excellent corrosion resistance property. This means that the material, having a metal structure containing a volume fraction of 30% amorphous structure, has notably improved corrosion resistance. On the other hand, comparative sample Nos. C5 and C6 exhibit deteriorated corrosion resistance and toughness properties while they are in the defined chemical composition range of the invention, because observed precipitates have a size of not less than 0.1 μm.

EXAMPLE III

Figure 5:
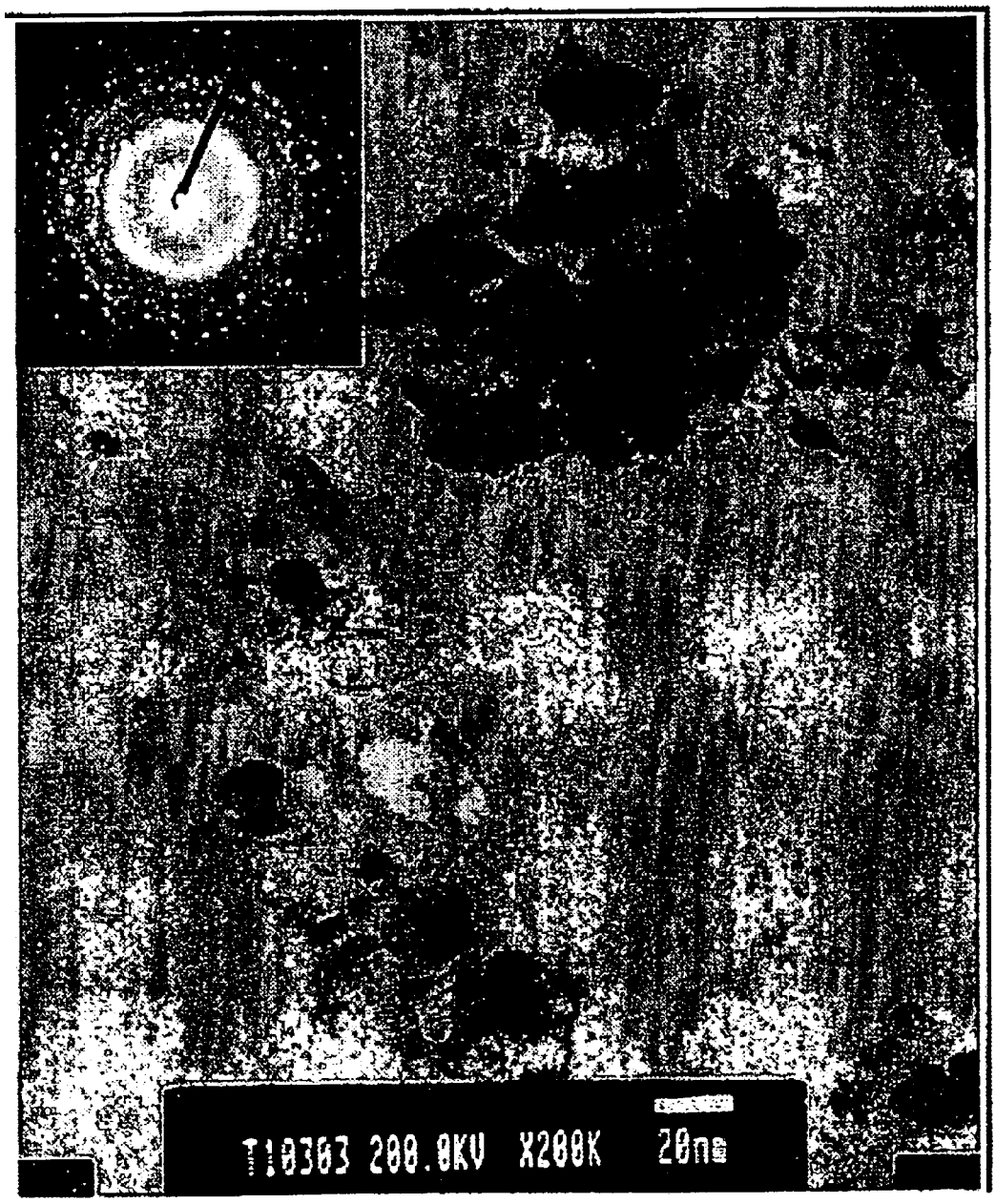
FIG. 5 is a micrograph by a transmission electron microscope showing an invention microstructure containing a volume fraction of not less than 30% amorphous structure.
Figure 6:
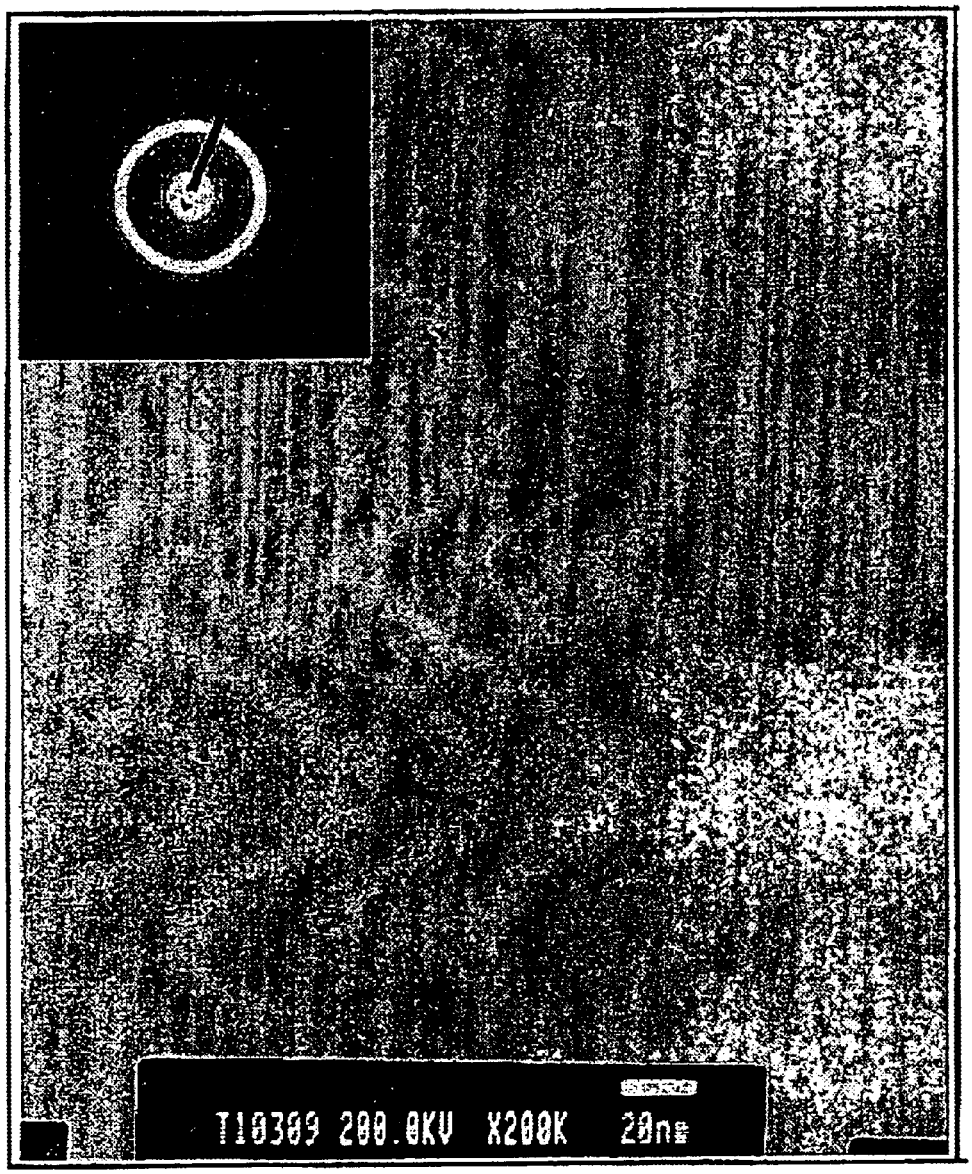
FIG. 6 is a micrograph by a showing an invention microstructure containing a volume fraction of not less than 80% amorphous structure.

Invention sample No. 5 raised in Table 1 was subjected to a heat treatment test (heating temperature: 350° C., keeping time at the temperature: 600 seconds) which was assumed to be a coating condition with utilization of polytetrafluoroethylene (PTFE). FIGS. 5 and 6 show micrographs, by a transmission electron microscope, of invention sample No. 5 which was heat treated under the conditions of (a) usual heating condition (heating rate: 0.6° C./s) and (b) rapid heating at not less than 80° C./s. Microstructures thereof were evaluated in accordance with the above-described way.

Invention sample No. 5 has a metal structure containing a volume fraction of 30% of an amorphous structure even under the heat treatment condition (a) (heating rate: 0.6° C./s) which is usual to that for coating with polytetrafluoroethylene (PTFE). Further, it has a metal structure containing a volume fraction of 80% of an amorphous structure under (b) 80° C./s of the rapid heating condition.

As described above, according to the invention, it is possible to provide a razor blade material having excellent properties of high hardness, high strength and high corrosion resistance as compared with conventional razor blade materials. A razor made of the invention material has sharpness. It is possible to notably improve the invention material so as to have shaving touch by means of coating with polytetrafluoroethylene (PTFE). When the invention material is subjected to such coating treatment, the amorphous structure is hardly lost even under the heat treatment condition. Further, when the invention material is produced by the quenching solidification method, razor blades can be produced directly from the material as solidified by quenching. Thus, it is possible to omit hot working, cold working and heat treatment after solidification by quenching, so that production process steps can be notably saved. Therefore, the present invention exhibits excellent advantageous effects.

What is claimed is:

1. A razor blade material made of an Fe-base alloy comprising, by mass %, not less than 0.5% carbon, 9.0 to 14.0% Cr and from more than zero to 8.0% Mo, wherein precipitates, which can be observed at an optional cross section of the razor blade material, have a diameter of less than 0.1 μm, respectively.

2. A razor blade material according to claim 1, which comprises, by mass %, 0.5 to 5.0% carbon and 0.5 to 8.0% Mo.

3. A razor blade material according to claim 2, not less than 30 volume % of which metal structure is amorphous.

4. A razor blade material according to claim 1, not less than 30 volume % of which metal structure is amorphous.

5. A razor blade material according to claim 4, which has a thickness of 30 to 100 μm.

6. A razor blade material made of an Fe-base alloy consisting essentially of, by mass %, not less than 0.5% carbon, 9.0 to 14.0% Cr and from more than zero to 8.0% Mo, B and/or Si in an amount as defined by the equation of $0<B+Si\leqq 8.0\%$, and the balance of Fe and unavoidable impurities, wherein precipitates, which can be observed at an optional cross section of the razor blade material, have a diameter of less than 0.1 μm, respectively.

7. A razor blade material according to claim 6, wherein the carbon amount is 0.5 to 5.0%, the Mo amount is 0.5 to 8.0%, and the amount of B+Si is 0.5 to 8.0%.

8. A razor blade material according to claim 7, not less than 30 volume % of which metal structure is amorphous.

9. A razor blade material according to claim 8, which has a thickness of 30 to 100 $\mu$m.

10. A razor blade material according to claim 6, not less than 30 volume % of which metal structure is amorphous.

11. A razor blade material made of an Fe-base alloy comprising, by mass %, not less than 0.5% carbon, 9.0 to 14.0% Cr and from more than zero to 8.0% Mo, wherein no precipitate can be observed at an optional cross section of the razor blade material.

12. A razor blade material according to claim 11, which comprises, by mass %, 0.5 to 5.0% carbon and 0.5 to 8.0% Mo.

13. A razor blade material according to claim 12, not less than 30 volume % of which metal structure is amorphous.

14. A razor blade material according to claim 11, not less than 30 volume % of which metal structure is amorphous.

15. A razor blade material according to claim 14, which has a thickness of 30 to 100 $\mu$m.

16. A razor blade material made of an Fe-base alloy consisting essentially of, by mass %, not less than 0.5% carbon, 9.0 to 14.0% Cr and from more than zero to 8.0% Mo, B and/or Si in an amount as defined by the equation of $0<B+Si\leqq 8.0\%$, and the balance of Fe and unavoidable impurities, wherein no precipitate can be observed at an optional cross section of the razor blade material.

17. A razor blade material according to claim 16, wherein the carbon amount is 0.5 to 5.0%, the Mo amount is 0.5 to 8.0%, and the amount of B+Si is 0.5 to 8.0%.

18. A razor blade material according to claim 17, not less than 30 volume % of which metal structure is amorphous.

19. A razor blade material according to claim 18, which has a thickness of 30 to 100 $\mu$m.

20. A razor blade material according to claim 16, not less than 30 volume % of which metal structure is amorphous.

21. A razor blade made of an Fe-base alloy comprising, by mass %, not less than 0.5% carbon, 9.0 to 14.0% Cr and from more than zero to 8.0% Mo, wherein precipitates, which can be observed at an optional cross section of the razor blade, have a diameter of less than 0.1 $\mu$m, respectively, and wherein the razor blade is coated with polytetrafluoroethylene (PTFE).

22. A razor blade made of an Fe-base alloy comprising, by mass %, not less than 0.5% carbon, 9.0 to 14.0% Cr and from more than zero to 8.0% Mo, wherein no precipitate can be observed at an optional sectional surface of the razor blade, and wherein the razor blade is coated with polytetrafluoroethylene (PTFE).

* * * * *